United States Patent [19]

Fischer et al.

[11] 4,438,675

[45] Mar. 27, 1984

[54] CABLING FOR SECONDARY AMMUNITION

[75] Inventors: Klaus H. Fischer; Heinz Kroschel, both of Troisdorf, Fed. Rep. of Germany

[73] Assignee: Dynamit Nobel Aktiengesellschaft, Troisdorf, Fed. Rep. of Germany

[21] Appl. No.: 311,765

[22] Filed: Oct. 15, 1981

[30] Foreign Application Priority Data

Oct. 31, 1980 [DE] Fed. Rep. of Germany ..... 3041149

[51] Int. Cl.[3] ..... F41F 1/00; F41F 5/02

[52] U.S. Cl. ..... 89/1.811; 89/1.5 R; 102/357

[58] Field of Search ..... 89/1.5 R, 1.811, 1.816, 89/1.8, 1 R; 102/342, 345, 351, 357, 393, 394, 705; 339/45 M

[56] References Cited

U.S. PATENT DOCUMENTS

| | | | |
|---|---|---|---|
| 2,847,652 | 8/1958 | Kokalas | 89/1.5 R X |
| 3,451,306 | 6/1969 | Lagerstrom et al. | 102/357 X |
| 3,787,012 | 1/1974 | Jakubowski | 89/1.5 R X |
| 3,808,941 | 5/1974 | Biggs | 89/1.5 R |
| 4,019,421 | 4/1977 | Ström | 89/1.5 R |
| 4,026,188 | 5/1977 | Woodruff et al. | 89/1.5 R |
| 4,099,038 | 7/1978 | Purdy | 89/1.811 X |
| 4,130,059 | 12/1978 | Block et al. | 102/351 |
| 4,164,887 | 8/1979 | Ouellette | 89/1.5 R |
| 4,184,731 | 1/1980 | Betzmeir | 89/1.811 X |
| 4,372,215 | 2/1983 | Crepin | 102/394 |

*Primary Examiner*—David H. Brown

*Attorney, Agent, or Firm*—Antonelli, Terry & Wands

[57] ABSTRACT

A cabling arrangement for secondary ammunition arranged in the form of at least two ammunition elements in series in a cylindrical casing of a distribution system and being ejectable therefrom. The cabling arrangement serves for supply of electrical energy and/or information to the secondary ammunition and includes a continuous electrical conductor system extending substantially in the longitudinal direction of the casing. The conductor system is provided with terminals correlated with the individual ammunition elements, the terminals establishing defined separating zones between the conductor system and the individual ammunition elements.

20 Claims, 7 Drawing Figures

CABLING FOR SECONDARY AMMUNITION

The present invention relates to the cabling of secondary ammunition wherein the cabling serves for supply of electrical energy or information to the secondary ammunition arranged in the form of at least two ammunition elements in a casing of a distribution system and being ejectable therefrom.

Cabling of secondary ammunition, such as mines, bomblets, subsidiary projectiles, or subsidiary shells in distribution systems, such as rockets, shells, or launching tubes, is conventional. Such cabling serves for providing electrical supply or program input for the individual ammunition elements accommodated in the casing of the distribution system prior to or directly during deployment. These cable systems have been constructed in the arrangements known heretofore so that, upon ejection of the secondary ammunition from the casing of the distribution systems, the electrical connections are severed at undefined locations. This may impair the ejection process. Furthermore, this may interfere, in case of secondary ammunition wherein the ammunition elements are arranged as a column-like stack in the cylindrical casing of the distribution system, in the spatial separation of the ammunition elements from one another after ejection, and thereby the distribution of the secondary ammunition may be impaired.

It is therefore an object of the present invention to provide a cabling for secondary ammunition which overcomes the disadvantages of prior arrangements.

It is another object of the present invention to provide a cabling construction for secondary ammunition wherein the cabling serves for supply of electrical energy and/or information to the secondary ammunition arranged in the form of at least two ammunition elements in a casing of a distribution system and being ejectable therefrom so that the ejection process and the distribution of the secondary ammunition are not adversely affected.

In accordance with the present invention, there is provided a cabling for secondary ammunition arranged in the form of at least two ammunition elements in series in a cylindrical casing of a distribution system and being ejectable therefrom, the cabling serving for supply of at least one of electrical energy and information to the secondary ammunition with the cabling being constructed as a continuous electrical conductor system extending at least essentially in the longitudinal direction of the casing and having terminals correlated with the individual ammunition elements and with defined separating zones. The individual ammunition elements arranged in series in the casing of the distribution system and/or their electric operating parts are connected by way of respectively one cable terminal to the continuous, single- or multiple-wire conductor system, especially a flat or ribbon conductor system. Furthermore, respectively one defined separating point in or at the cabling is associated with the individual ammunition elements. Thus, a defined separation of the ammunition elements from the cabling is ensured during the ejection process, and a perfect resolution of the ammunition stack into mutually spatially separated, individual ammunition elements is made possible, as a prerequisite for a perfect distribution of the secondary ammunition.

According to an advantageous feature of the present invention, the cable terminals are fashioned as web-, pin-, tongue-, or tab-like or similar connections formed at their free ends facing the ammunition element as a plug or socket to connect with a corresponding socket or plug at the ammunition element. This plug-and-socket connection between the cable terminal and the ammunition element represents a simple and yet reliable, defined separating point between the cabling and the individual ammunition elements. The terminals are preferably flexible and are constructed, for example, in such a way that correspondingly short cable sections, constituting the terminal or junction, are electrically conductively connected to the continuous conductor system in series at a spacing determined by the ammunition elements. However, it is also possible to fold the conductor system proper into loops at the aforementioned spacings, to press the loop flat to form the tongue-shaped terminal, and to fashion the latter as a plug or socket at the free end.

If the ejection of the ammunition elements from the casing of the respective distribution system takes place only in one and the same direction in all cases, then an arrangement of the cable terminals wherein the terminals with the plug or socket connections leading to the ammunition elements are arranged—as seen in the ejection direction of the ammunition elements—with respect to the continuous conductor system at an acute angle and which is preferably at an angle of $\leqq 45°$ proves to be advantageous, according to which the terminals point with their free ends so to speak into the ejection direction. Consequently, during the ejection, the plug-and-socket connection is immediately stressed by tensile forces by the movement of the ammunition elements and thereby is very quickly separated. If the conductor system is arranged on the inside of the distribution casing, this movement furthermore causes the flexible terminals to smoothly contact the inner wall and/or the conductor system, so that the ammunition elements can slide past unimpeded.

Applications are possible wherein the secondary ammunition must also be ejectable into the other direction, either because this ammunition is to be deployed in a distribution system with the opposite ejection direction or because it is to be ejectable from one and the same cylindrical distribution casing into both directions. For this purpose, an arrangement wherein the contacts of the plug or socket connections correlated with the ammunition elements are arranged—as seen in one direction of ejection—at an acute angle $\beta$, preferably at an angle of $\leqq 45°$ with respect to the longitudinal axis of the casing; and the terminals of the conductor system are arranged with their contacts—as seen in the same direction of ejection—at a corresponding angle $\alpha$ with respect to the continuous conductor system, and the contacts of the ammunition elements are connected with the respectively opposed contact of the terminals by means of intermediate plugs or sockets is provided. In this manner, the plugs or sockets of the terminals of the conductor system and the associated plugs or sockets of the ammunition elements point with their free connection end into the same ejection direction and are connected with one another by means of a correspondingly bent or curved intermediate plug or socket, preferably equipped with a flexible cable section. Thus, there are two plug or socket connections between the conductor system and the ammunition element moving relatively thereto, respectively one of these plug or socket connections being placed under tensile stress and thus severed, independently of the direction, of those two directions, into which the ammunition element is ejected.

The conductor system is generally arranged as a continuous cable between the outer wall of the secondary ammunition elements and the inner wall of the distribution casing and can additionally be fixed in place, to hold it at its end facing away from the ejection side, on the inner wall of the distribution casing in a spotwise fashion or also over its entire length, preferably by means of an adhesive compound or an adhesive film. The conductor system, however, can also be arranged on the outer wall of the distribution casing and can be extended with its terminals through the wall of the casing to the ammunition elements.

Instead, however, the provision can also be made according to another feature of the present invention, to provide a continuous conductor system wherein the cabling is continuously composed of conductor sections arranged within the ammunition elements and equipped with a branch or junction for connection to the electrical components of the ammunition elements by way of plug or socket connections between neighboring ammunition elements, by providing the conductor sections with plug or socket contacts in the region of the mutually opposed surfaces of each ammunition element, which surfaces are arranged to force adjacent ammunition elements. Thus, the conductor system is installed so to speak in the interior of the ammunition elements. Also in this case, the conductor system is connected via respectively one terminal with the electrical operating part of the ammunition elements, but the defined separating zone is not formed in the area of the terminal but rather between the conductor sections of neighboring ammunition elements joined together by plugs, i.e., by way of a plug and a corresponding socket. The ejection can take place in the same way via one or the other end of the distribution casing. The ammunition elements are in this case—just as in the aforementioned embodiments—arranged preferably in an abutting fashion, i.e., in the form of a column within the distribution casing. To obtain exact guidance and contacting during the step of placing the ammunition elements one on top of the other or one behind the other, a construction wherein the ammunition elements are provided on their mutually opposed surfaces with projecting guide elements and corresponding recesses in such a way that in the series arrangement of two ammunition elements, the guide elements engage into the recesses and position both ammunition elements in an exact mutual position before their plug or socket contacts inter-engage when the ammunition elements are pushed into closer juxtaposition proves to be advantageous.

These and further objects, features and advantages of the present invention will become more obvious from the following description when taken in connection with the accompanying drawings which show, for purposes of illustration only, several embodiments in accordance with the present invention, wherein.

Figure 5A:
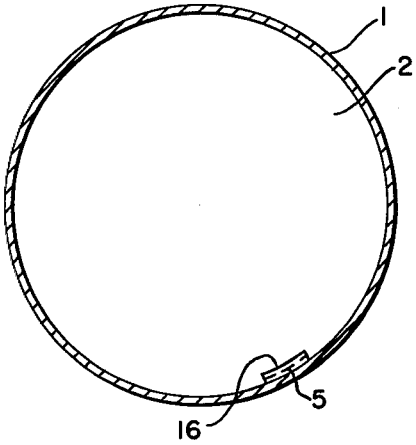
Figure 6:
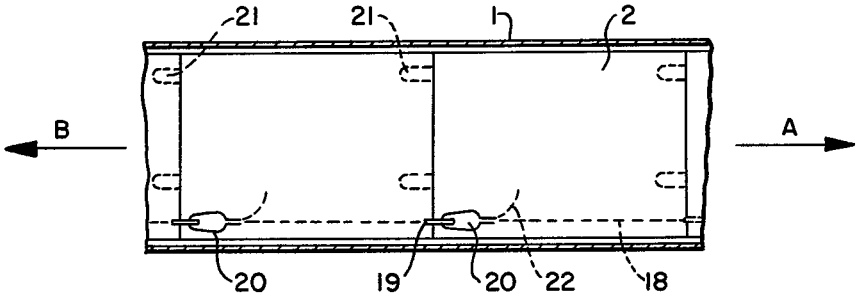

FIGS. 5a and b illustrate different cross sections of the distribution casing with installation space for the cabling; and FIG. 6 shows an internal cabling arrangement for the ammunition elements.

Referring now to the drawings wherein like reference numerals are utilized to designate like parts throughout the several views, there is shown in longitudinal section a cylindrical casing 1 of a distribution system for ammunition elements 2 comprising secondary ammunition. The ammunition elements are arranged in series as a stack or column within the cylindrical casing. At the left-hand side, the casing 1 is provided with a sealed end 1' and a pyrotechnical ejection charge 3 and an adapter base or sabot 4 are furthermore arranged thereat. Ejection takes place via the other end of the casing (not shown) in the direction indicated by arrow A. A cabling in the form of a continuous conductor system 5 is extended through the end 1' into the interior of the distribution casing 1 and thus mounted in place, and is guided along in the axial direction between the outer wall of the ammunition elements 2 and the inner wall of the distribution casing 1. The conductor system 5 comprises flexible terminals 6 for the individual ammunition elements with a defined separating zone 7 being formed at the free ends of these terminals as a plug or socket connection to the ammunition element 2. The flexible terminals may be tongue-, web-, pin-, tab-like shaped. The terminals 6 are arranged at an acute angle $\alpha \leqq 45°$ toward the substantially axially extending conductor system 5 and point with their free or contact end into the ejection direction A. During the ejection step, the plug and socket connections are released by the movement of the ammunition elements in the distribution casing 1, and the terminals 6 are laid against the cable 5 and/or the inner wall of the distribution casing 1 in such a way that the ammunition elements can slide past without being impeded. This ensures that the electrical connections are severed during ejection at defined points, and the entire cabling does not impair the ejection process and the distribution of the secondary ammunition.

Figure 1:
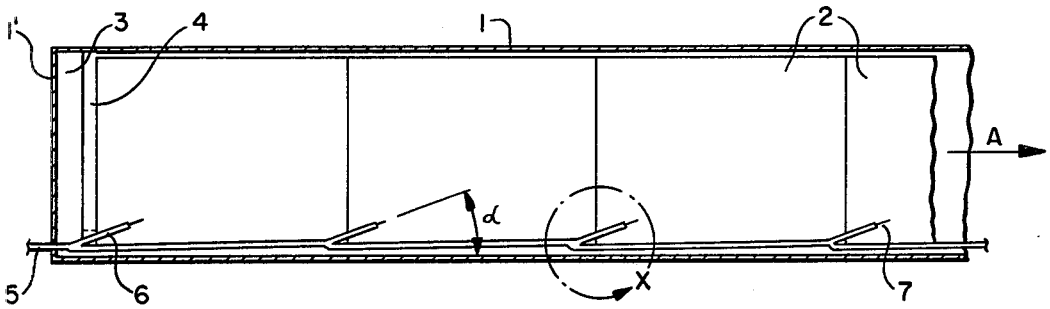
FIG. 1 shows an embodiment of the rear portion of a distribution casing in a longitudinal section having cabling in accordance with the present invention.
Figure 2:
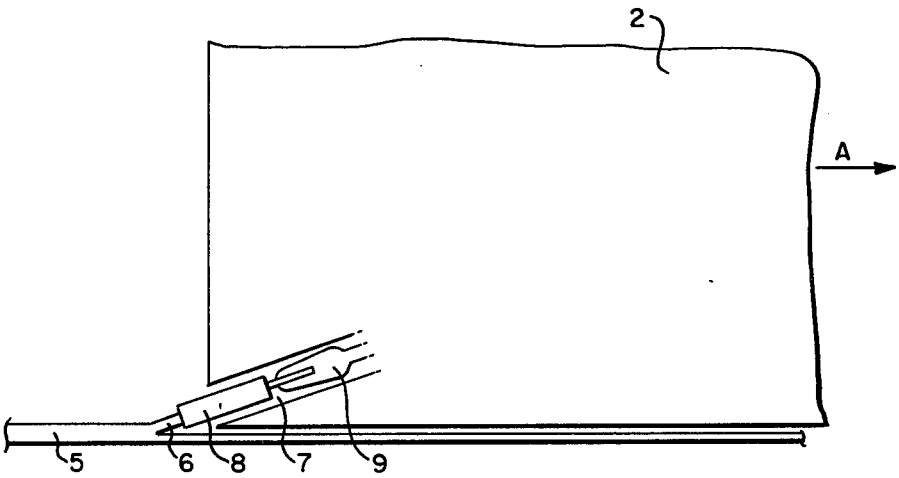
FIG. 2 shows a detail X of FIG. 1 in an enlarged scale illustrating a plug and socket connection.
Figure 3:
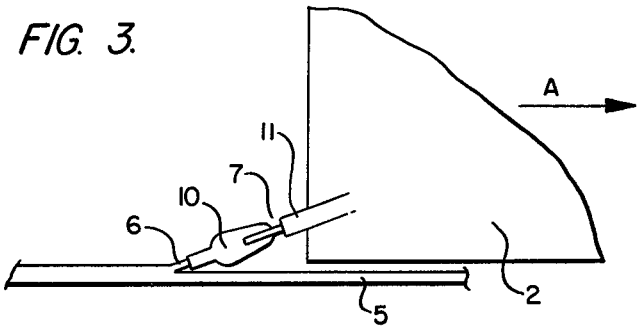
FIG. 3 shows another embodiment in accordance with the present invention.

FIG. 2 shows an enlarged view of the detail X of FIG. 1 including a fragmentary view of an ammunition element 2 with a section of the conductor system 5. The terminal 6 of the conductor system 5 is fashioned as a plug 8 engaging into the corresponding socket 9 of the ammunition element 2. The plug 8 and the socket 9 form the defined separating zone 7. FIG. 3 shows a reversal, in that the terminal 6 to form the separating zone 7 is provided with the socket 10 engaged by the plug 11 of the ammunition element 2.

Figure 4:
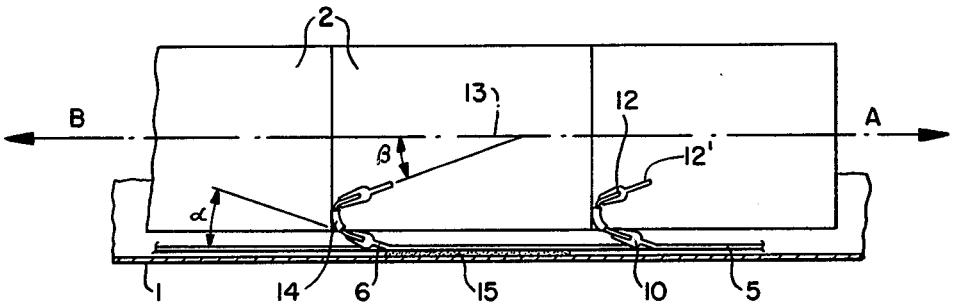
FIG. 4 shows a further embodiment of cabling with an intermediate plug or socket.

FIG. 4 shows a type of cabling wherein ejection is possible from the casing in the direction of arrow A as well as, in opposition thereto, in the direction of arrow B, for example to adapt to varying laying or distribution systems. The terminals 6 with sockets 10 of the conductor system 5 are again arranged so that they are inclined at the angle $\alpha \leqq 45°$. The connector 12 of the ammunition elements 2, here also a female socket, is arranged at an angle $\beta \leqq$ ·.·° with respect to the longitudinal axis 13 of the casing, namely oriented in such a fashion that the free ends of both sockets 10 and 12 point in the same direction, i.e., in the direction of arrow B. The angles $\alpha$ and $\beta$ are in this case of equal size, but they can also be different from each other. The other end 12' of the female socket 12 is connected to the electrical operating part, not shown, of the ammunition elements 2. Both sockets 10, 12 are electrically conductively joined by means of the flexible intermediate connector in the form of a plug 14. The continuous conductor cable 5 can be affixed to the inner wall of the casing with an adhesive compound or an adhesive film 15.

Figure 5B:
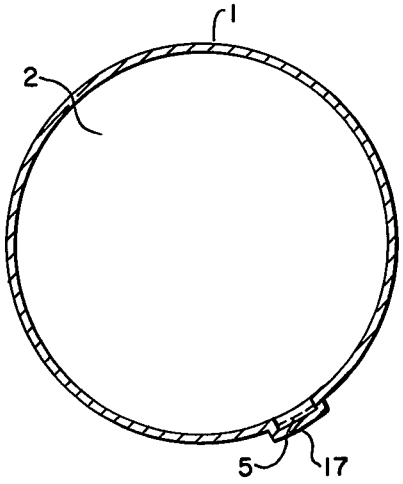

These cabling arrangements are preferably constructed as flat cables or round-wire ribbon cables in order to save space. The installation room for the cabling 5 between the ammunition elements 2 and the distribution casing 1 is dimensioned so that the provided branch terminals 6 do not lead to jamming during ejection. Mounting room can be provided according to FIG. 5a as a continuous groove 16 at the ammunition elements 2 or as shown in FIG. 5b, as groove 17 in the distribution casing 1.

If the construction of the ammunition elements 2 permits the laying of a conductor through the interior thereof, it is preferred as shown in FIG. 6 to lay the conductor in the axial direction, i.e., in the ejection direction, in the form of a conductor section 18. The connecting points at the topside and bottom side of the ammunition elements 2 in the form of a male connector or plug 19 and a female connector or socket 20 are arranged so that the elements can be stacked under contacting. Furthermore, recesses 21 are provided on the topside of the ammunition elements 2 wherein positioning bolts or pins (not shown), engage with a sliding fit during the mutual placement of the ammunition elements 2 before the plug contacts are engaged. This ensures an exact guidance and contacting when the ammunition elements are placed one beside the other. The terminals 22 of the conductor sections 18 are connected to the electrical operating part, not shown, of the ammunition elements 2. This arrangement of the cabling makes it possible, just as the system shown in FIG. 3, to eject the ammunition elements 2 in the direction of arrow A as well as in the direction of arrow B.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

We claim:

1. A cabling arrangement for secondary ammunition arranged in the form of at least two ammunition elements in series in a cylindrical casing of a distribution system and being ejectable therefrom, the cabling arrangement serving for supply of at least one of electrical energy and information to the secondary ammunition, the cabling arrangement comprising a continuous electrical conductor system extending substantially in the longitudinal direction of the casing, the conductor system being provided with terminals at spaced positions along the conductor system so that respective ones of the spaced terminals are correlated with respective ones of the individual series arranged ammunition elements, the terminals establishing defined separating zones between the conductor system and the individual ammunition elements.

2. A cabling arrangement according to claim 1, wherein the separating zones are formed at the connection between the individual series arranged ammunition elements and the spaced terminals of the conductor system.

3. A cabling arrangement according to claim 1, comprising means for retaining the conductor system and the terminals thereof within the casing upon ejection of the ammunition elements from the casing.

4. A cabling arrangement according to claim 1, wherein the conductor system comprises conductor sections arranged within the ammunition elements and provided with a junction for connection to electrical components of the ammunition elements, the conductor sections having the terminals thereof arranged in the region of mutually opposed surfaces of each ammunition element, the mutually opposed surfaces being arranged to face adjacent ammunition elements.

5. A cabling arrangement according to claim 4, wherein the ammunition elements include projecting guide elements and corresponding recesses on the mutually opposed surfaces of adjacent ammunition elements so that for a series arrangement of two ammunition elements, the projecting guide elements engage into the corresponding recesses and position the two ammunition elements in an exact mutual position prior to interengagement of the terminals of the conductor sections occurring when the two ammunition elements are pushed into closer juxtaposition.

6. A cabling arrangement according to claim 5, wherein the terminals are in the form of one of plug and socket connections.

7. A cabling arrangement according to claim 6, wherein each conductor section has a terminal in the form of a plug arranged at one surface of the ammunition element and a terminal in the form of socket arranged at another surface of the ammunition element.

8. A cabling arrangement according to claim 1, wherein the terminals of the conductor system provide one of a plug and socket connection with a corresponding one of the other of a plug and socket connection of the respective ammunition elements, the separating zones being formed at the connection therebetween.

9. A cabling arrangement according to claim 8, wherein the terminals are configured as one of a web-, pin-, tongue- and tab-like shaped member forming the at least one of the plug and socket connection.

10. A cabling arrangement according to claim 8, wherein the ammunition elements are provided with a groove extending in the longitudinal direction of the casing, the continuous electrical conductor system being disposed in the groove of the ammunition elements.

11. A cabling arrangement according to claim 8, wherein the casing is provided with a groove extending in the longitudinal direction of the casing, the continuous electrical conductor system being disposed in the groove.

12. A cabling arrangement according to claim 8, wherein the continuous electrical conductor system is a flat conductor member.

13. A cabling arrangement according to claim 12, wherein the flat conductor member is one of a single and multi-wire conductor.

14. A cabling arrangement for secondary ammunition arranged in the form of at least two ammunition elements in series in a cylindrical casing of a distribution system and being ejectable therefrom, the cabling arrangement serving for supply of at least one of electrical energy and information to the secondary ammunition, the cabling arrangement comprising a continuous electrical conductor system extending substantially in the longitudinal direction of the casing, the conductor system being provided with terminals correlated with the individual ammunition elements and with the terminals establishing defined separating zones between the conductor system and the individual ammunition elements, the terminals of the conductor system providing one of a plug and socket connection with a corresponding one of the other of a plug and socket connection of the respective ammunition elements, the separating zones being formed at the connection therebetween, and the terminals of the conductor system being disposed in the casing so as to extend at an acute angle with respect to the continuous electrical conductor system, the acute angle opening in an ejection direction of the ammunition elements.

15. A cabling arrangement according to claim 14, wherein the acute angle is an angle of ≦45°.

16. A cabling arrangement for secondary ammunition arranged in the form of at least two elements in series in a cylindrical casing of a distribution system and being ejectable therefrom, the cabling arrangement serving for supply of at least one of electrical energy and information to the secondary ammunition, the cabling arrangement comprising a continuous electrical conductor system extending substantially in the longitudinal direction of the casing, the conductor system being provided with terminals correlated with the individual ammunition elements and with the terminals establishing defined separating zones between the conductor system and the individual ammunition elements, the terminals of the conductor system providing one of a plug and socket connection with a corresponding one of the other of a plug and socket connection of the respective ammunition elements, the separating zones being formed at the connection therebetween, and the ammunition elements being ejectable in either of two opposing directions of the longitudinal direction of the casing of the distribution system, the ammunition elements having contacts of the one of plug and socket connections thereof arranged at an acute angle with respect to the longitudinal axis of the casing, the acute angle opening in one direction of ejection, and the terminals of the conductor system having contacts of the one of the plug and socket connections thereof arranged at a corresponding angle with respect to the conductor system, the corresponding angle opening in the one direction of ejection, the contacts of the ammunition elements being connected with the respectively opposed contacts of the terminals of the conductor system by respective intermediate connectors.

17. A cabling arrangement according to claim 16, wherein the intermediate connectors are flexible connectors in the form of one of plugs and sockets, and the contacts of the ammunition elements and the contacts of the terminals being the other of the plugs and sockets.

18. A cabling arrangement according to claim 17, wherein the intermediate connector is in the form of plugs and the contacts of the ammunition elements and the contacts of the terminals are in the form of sockets.

19. A cabling arrangement according to claim 17, wherein the acute angle and the corresponding angle are angles of ≦45°.

20. A cabling arrangement according to claim 19, wherein the acute angle and the corresponding angle are equal angles.

* * * * *